United States Patent [19]

Larson

[11] 4,253,407

[45] Mar. 3, 1981

[54] BURNER FOR COMBUSTING PARTICULATE FUELS

[76] Inventor: Arnold Larson, P.O. Box 595, Pagosa Springs, Colo. 81147

[21] Appl. No.: 20,613

[22] Filed: Mar. 14, 1979

[51] Int. Cl.[3] ..... F23B 1/20; F23H 1/02; F23H 17/08; F23K 3/00

[52] U.S. Cl. ..... 110/267; 110/102; 110/108; 110/291; 110/327; 126/152 B; 126/153

[58] Field of Search ..... 110/102, 101 R, 108, 110/109, 267, 268, 281-285, 327, 328, 291; 126/152 R, 152 B, 153

[56] References Cited

U.S. PATENT DOCUMENTS

| | | | |
|---|---|---|---|
| 1,302,164 | 4/1919 | Hollenbeck | 110/267 |
| 1,344,144 | 6/1920 | Packard | 110/285 |
| 1,974,431 | 9/1934 | Priebe et al. | 110/267 X |
| 2,049,976 | 8/1936 | Riddell | 110/267 X |
| 2,234,416 | 3/1941 | Riddell | 110/267 |
| 2,428,874 | 10/1947 | Gough | 110/284 |

*Primary Examiner*—John Petrakes

*Attorney, Agent, or Firm*—Webb, Burden, Robinson & Webb

[57] ABSTRACT

A burner for combusting particulate fuels comprises a combustion chamber fitted with a plurality of grates stacked in stairstep fashion, each having a downwardly sloping surface over which the fuel flows continuously as it burns. The grates may be horizontally adjustable to change the downward slope of the flowing fuel. Each grate rests upon supports projecting from opposite side walls of the burner. The supports extend beyond the downwardly sloping surfaces of the grates and beyond the forward edge of the fuel bed so that the flow of fuel is diverted by the supports away from the side walls of the firebox, creating air passages which allow air to flow directly to the flame. The burner is fitted with a hopper for receiving and containing the fuel with a baffle plate depending from it shaped to distribute the fuel across the width of the grate in a manner which promotes the flow of the fuel. Tubular channels are positioned below the lowermost grate so that air is supplied to any unburned fuel accumulating at the bottom of the incinerator.

28 Claims, 5 Drawing Figures

BURNER FOR COMBUSTING PARTICULATE FUELS

BACKGROUND OF THE INVENTION

1. Field of Invention

This invention relates generally to burners, and more particularly to burners designed to generate heat for a variety of uses by combusting particulate fuels such as sawdust, pelletized refuse, and the like or burners designed to dispose of excess materials simply by clean incineration.

2. Description of Prior Art.

There are many occasions in industry for the efficient combustion of particulate material. For example, in the lumber industry there is a need for a means to burn sawdust for steam generation and/or disposal. Where the fuels are readily available, home burners for space and water heating are commonly used. With increasingly strict air pollution laws, especially in those states with a heavy lumber industry, there is a need for a burner that combusts the sawdust efficiently with little or no smoke or fly ash. Such a burner must also be able to function safely in less than ideal conditions in which wet fuel or sawdust must be burned.

A commonly used burner for this purpose comprises a combustion chamber having a top-mounted hopper which feeds the fuel directly onto a series of grates within the combustion chamber stacked in stairstep fashion. As the fuel flows down the grates to the bottom of the combustion chamber, it mixes with combustion air drawn through the grates and burns. This air can be provided to the combustion chamber by the natural draft created when the fuel burns and the hot combustion gases exiting the combustion chamber draw air into the combustion chamber through perforations in or openings between the grates. Examples of this type of incinerator are found in U.S. Pat. Nos. 1,641,545; 1,840,668; and 2,183,648. Another method of supplying combustion air is by forcing it through the fuel by the use of air blowers located within the grates or mounted in the walls of the combustion chamber. This also agitates the fuel and urges it down the grates. An example of this method is found in U.S. Pat. No. 3,812,794.

An inherent problem in burning particulate fuels in this manner is the tendency of the fuel to burn out locally generating holes and pillars—clumps of charred, sintered fuel—along the width of the grates. The pillars hold back the fuel preventing it from filling the holes. When the pillars weaken and collapse, a rush of fuel cascades down the grates burying the partially burned fuel. This generates smoke and gases which can accumulate in the combustion chamber and explode, resulting in damage to the burner and injury to bystanders. Attempts in prior art devices to prevent pillaring by spreading the fuel across the grate have resulted in the accumulation of unburned fuel in corners located where the edge of a grate meets a wall of the combustion chamber and is caused by the relative absence of air in these corners.

Therefore, it is an object of the invention to provide a particulate fuel burner utilizing grates stacked in stairstep fashion in which the fuel flows continuously down the grates as it burns. This will greatly reduce pillaring of the fuel on the grates and will virtually eliminate intermittent cascading of the fuel and with it the attendant smothering of the fire, accumulation of explosive gases within the combustion chamber, and generation of excess smoke.

It is also an object of the invention to provide a burner in which the fuel is distributed across the grates so that it flows downward in a manner that promotes even mixing with the air, a reduction in pillaring, and has a fire-sustaining motion down the grates.

Another object of the invention is to provide a burner in which air for combustion can bypass the flow of fuel down the grates to be supplied directly to fuel located on a grate adjacent a wall of the combustion chamber so that burning is maintained on each grate at all times and so that air is available beyond the grates to assure complete combustion of all flammable gases and fumes.

An additional object of the invention is to provide a burner in which the rate of flow of fuel down the grates can be varied by adjusting the position of the grates relative to one another to vary the slope down which the fuel flows, thus compensating for slower burning fuel such as wet sawdust.

It is also an object of the invention to provide a burner which contains an easily adjustable means for bringing air to unburned particles that collect beyond the base of the lowermost grate.

It is a further object of this invention to provide a burner in which air for combustion may be supplied either by natural draft or by mechanically forced air, although natural draft is preferred.

It is also an object of the invention to provide a burner which operates efficiently without the use of outside power or sophisticated electronic controls and whose grates can be constructed of relatively inexpensive plate or sheet metal parts.

Another object of the invention is to provide a burner that easily can be retrofitted into presently existing boiler, heater, and incinerator systems to bring them into compliance with Federal emission regulations.

BRIEF DESCRIPTION OF THE INVENTION

The invention is a burner for combusting particulate fuel which comprises a combustion chamber containing a series of grates stacked in stairstep fashion. A hopper located on top of the device communicates with the combustion chamber so that fuel received by the hopper is deposited primarily on the front slope of the grates. A baffle plate extends from the base of the hopper to the vicinity of the uppermost grate and is shaped so that the fuel flowing under it is distributed across the grate in a layer thicker toward the side walls than in the center of the grate. The portion of each grate over which the fuel flows is sloped downward so that the thickness of the fuel bed—the stream of particulate fuel flowing over the grates—is reduced and the fuel flows downward continuously with little accumulation on the grates. Each grate rests upon a pair of supports which are attached to the opposing walls of the combustion chamber and extend inward toward the center. The supports are longer than the grates so that the grates can be moved relative to each other in order to control the rate of flow of fuel over the grates. In addition, a portion of the supports will at all times extend beyond the sloping portion of the grate it supports and beyond the fuel bed to provide a bypass air passage to the portion of the downward flowing fuel adjacent the walls of the combustion chamber to insure the continuous existence of flame and complete combustion of the fuel in those areas.

This invention also includes an adjustable opening, located adjacent the hopper in the top of the combustion chamber directly above the burning fuel, to supply additional air to the downward flowing fuel. The size of the opening is variable to provide a measure of control of the flame size and shape and thus reduces the amount of smoke produced.

When strong draft is being used, unburned or partially burned fuel may accumulate on the bottom of the combustion chamber beyond the grates. Complete combustion of this accumulation is enhanced by providing air directly to the area. One means is by the insertion of at least one channel into the combustion chamber beneath the lowermost grate to supply air directly to unburned or partially burned fuel.

BRIEF DESCRIPTION OF THE DRAWINGS

The invention will be further illustrated with its objects becoming apparent by referring to the accompanying drawings wherein.

DESCRIPTION OF THE PREFERRED EMBODIMENT

Figure 1:
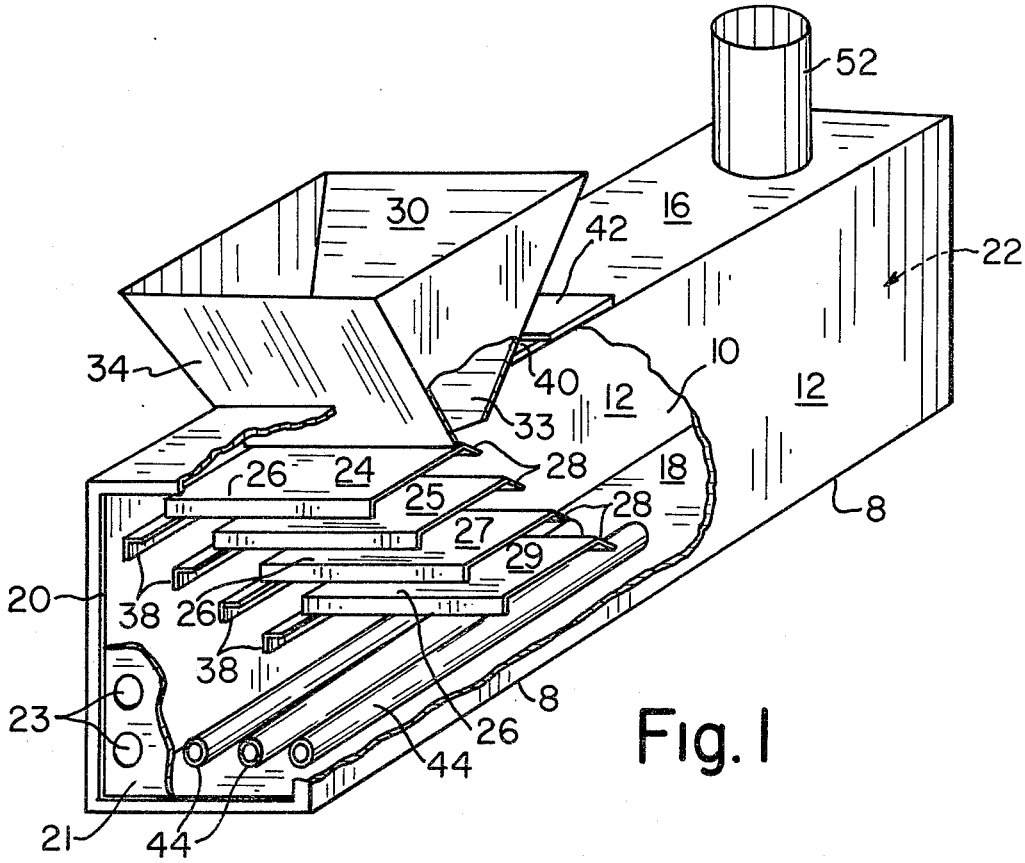
FIG. 1 is a perspective view of the burner partially cut away to show the interior of the combustion chamber; for clarity, no heat exchanger or boiler tubes are shown and only 4 grates are represented.

The preferred embodiment of the burner, generally designated 8, comprises a combustion chamber 10 having opposed walls 12, a top 16, a bottom 18, an open end 20 and a closed end 22, FIG. 1. The open end 20 is fitted with a door 21 (shown partially cut away in FIG. 1) having a plurality of vents 23 which can be covered to control the amount of draft. A plurality of grates 24, 25, 27, 29 stacked in stairstep fashion are located within the combustion chamber 10. Each grate has a substantially horizontal surface, generally designated 26, and a downwardly sloping surface, generally designated 28. A hopper 30 having a forward surface 32 and rearward surface 34 is attached to the top of the combustion chamber 10 and is positioned above the sloping surface 28 of the uppermost grate 24. A baffle plate 33 extends from the forward surface 32 of the hopper 30 toward the downward sloping surface 28 of the uppermost grate 24. The rearward surface 34 of the hopper 30 extends to the uppermost grate 24 to confine the fuel to the front portion of grate 24. A plurality of supports, typically angle iron, generally designated 38, are attached to the walls 12 and extend outward to support the grates 24, 25, 27, 29.

A slot 40 is located in the top 16 adjacent to the forward surface 32 of the hopper 30. A means for regulating the opening is shown in FIG. 1 as a simple rectangular plate 42 which is slightly larger than the slot 40.

Figure 3:
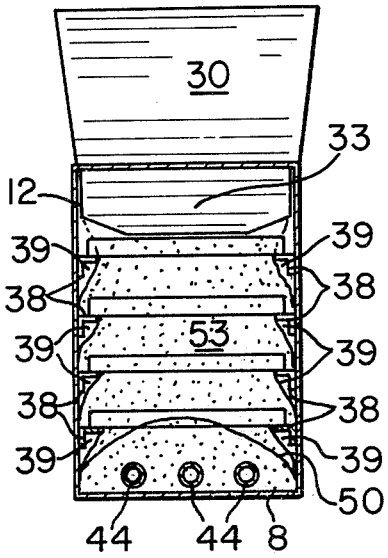
FIG. 3 is a sectional end elevation of the burner of FIG. 2 taken at line III—III.
Figure 4:
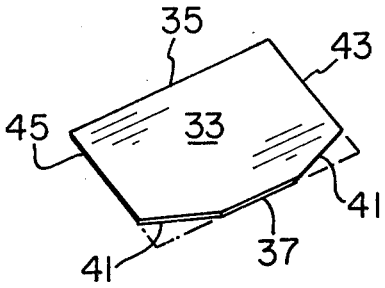
FIG. 4 is a perspective view of the baffle plate of the preferred embodiment.

Along the floor 18 of the combustion chamber 10 is located a plurality of pipes, generally designated 44. The pipes 44 are of a length sufficient to extend from a point in between the open end 20 and the lowermost grate 29 to a point in between the lowermost grate 29 and the closed end 22, FIG. 2. The battle plate 33 of the preferred embodiment has an upper edge 35, a lower edge 37, sides 43 and beveled edges 41, FIG. 4. As shown in FIG. 3, the upper edge 35 of the plate 33 is attached to the bottom of the hopper 30 on its forward surface 32 and the lower edge 37 of the battle plate 33 is adjacent the downwardly sloping surface 28 of the uppermost grate 24.

The combustion chamber 10 is provided with a chimney 52 which is located on the top 16 of the combustion chamber adjacent the closed end 22, FIG. 1.

Figure 2:
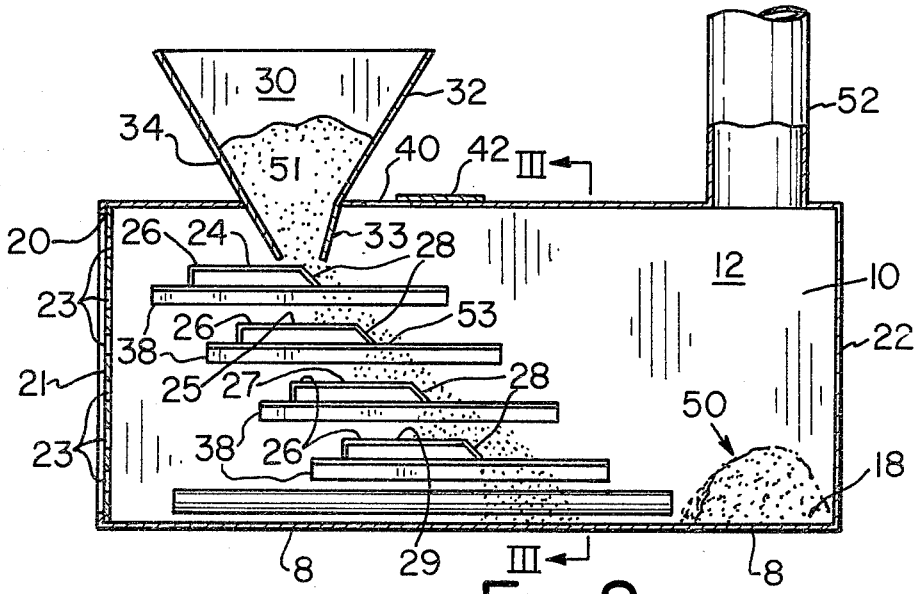
FIG. 2 is a sectional side elevation of the burner of FIG. 1 taken midway through the burner.

The operation of the burner 8 is shown more clearly in FIG. 2. Particulate fuel 51 contained in the hopper 30 flows onto the downwardly sloping surfaces 28 of the grates. As the fuel burns, it moves down the grates 24, 25, 27, 29 and the products of combustion exit the combustion chamber 10 via a heat exchanger (not shown) and then through the chimney 52. This creates a draft which draws primary air through the vents 23 in the door 21 of the open end 20 and through the fuel into the combustion chamber 10. This primary air passes between the grates and thoroughly intermixes with the fuel 51 as it flows down the sloping surfaces 28 of the grates 24, 25, 27, 29. In this fashion, the fuel 51 is flowing downward constantly as it burns. Thus, there is less opportunity for pillaring and the associated undesirable intermittent cascading of the fuel 51 is greatly reduced.

With the burning of dry particulate fuels, this process results in the complete combustion of the fuel by the time it reaches the floor 18. However, the burning of wet fuels or using heavy draft flow may result in the accumulation of unburned fuel fines in a pile 50 beyond the lowermost grate 29 which may impede the efficiency of a heat exchanger. It is in these instances that the pipes 44 are utilized to draw air through the vents 23 and bring it to the pile 50 to burn the accumulated unburned fuel. The draft created by the hot gases rising through the chimney 52 causes the air pressure in the area of the combustion chamber 10 adjacent the chimney 52 to be reduced. The outside air, at a relatively higher pressure, will seek to enter this reduced pressure area through any opening possible. The vents 23 and slot 40 are examples of such openings. The pipes 44, which communicate with the vents 23, are another such opening. Therefore, air will pass through the vents 23 and pass through both the fuel bed 53 and the pipes 44. As shown in FIG. 2, the pipes 44 are located at the bottom of the combustion chamber 10 and far enough into the chamber to avoid blockage by the fuel bed 53. The position of the pipes 44 can be adjusted relative to the lowermost grate 29 to deliver primary air to unburned fuel 50 anywhere along the bottom 18. The pipes 44 also serve as a source of secondary air to combust gases and vapors completely before they exit through the chimney 52.

Secondary air is also supplied to the burning fuel by means of the slot 40 located adjacent the hopper 30. The secondary air is drawn into the combustion chamber 10 by the draft created by combustion gases exiting the chimney 52. The induction of secondary air through the slot 40 directly affects the size of the flame and the smoke generation from the burning fuel 51 on the grates. An additional advantage of the induction of secondary air is that it helps burn fuel particles suspended in the air above the grates. The flame size, enhanced by the secondary air flowing through the slot 40, is controlled by the plate 42 which can be moved to cover the slot partially or completely.

Essential to the combustion of the fuel is the distribution of the fuel across the width of the grates by the baffle plate 33 and the corner air spaces 39 created by the supports 38, shown more clearly in FIG. 3. The configuration of the supports 38 act to block the flow of fuel 51 along the fuel bed 53 at the walls 12 creating air passages 39 in a small area just below the supports 38. As the fuel 51 moves downward on the grates 28, it also moves along the walls 12 until it reaches the supports 38. The supports 38 jut out into the chamber 10 and prevent the fuel 51 from maintaining complete contact with the walls 12. The fuel 51 is diverted around the supports 38 and continues to move downward and, also, back toward the walls 12. Because a certain vertical distance of travel is required before the fuel again reaches the walls 12, an air passage 39 will remain. The air passages 39 bring primary air drawn through the vents of the open end door around the fuel to sustain a flame at these points during all conditions of fuel flow. This provides continuous ignition preventing explosive situations and providing air for complete combustion of gases beyond the fuel bed 53. For maximum safety, the supports 38 must extend beyond the fuel bed 53. Since the burning is now continuous near the walls 12, the beveled edges 41, FIG. 4, of the baffle plate 33 of the present invention alter the natural downward flow of the fuel and cause the fuel to be distributed across the downwardly sloping surface 28 of the grates so that more fuel is flowing on the portion of the grates near the walls 12 than at the midsection of the grate. Even though a greater quantity of fuel 51 is flowing on the grates 28 near the walls 12, the air passages 39 will continue to be maintained because regardless of the amount of fuel flowing, a finite vertical drop will be necessary before the fuel, diverted by the supports 38, again comes in contact with the walls 12. This variation in distribution of fuel was found to be most effective in sustaining combustion, reducing pillaring of the fuel and promoting continuous, uniform flow.

While the grates 24, 25, 27, 29 may be moved along their respective supports 38 collectively or individually to vary the rate of downward flow of the fuel depending on its characteristics, at no time may a downwardly sloping surface 28 extend beyond the end of a support for this will cause the flowing fuel 51 to block the flow of air through the air passage 39 of the flame. While the preferred embodiment of the burner 8 shown in FIG. 2 has the downwardly sloping surfaces 28 lying in the same plane, experiments with the placement of grates 24, 25, 27, 29 along their respective supports 38 have shown that burn-out along the lower grates can be prevented when the downwardly sloping surfaces 28 of middle grates 25, 27 are moved slightly out of line toward the open end 20. In this arrangement, the fronts of the grates 24, 25, 27, 29 are on a downwardly sloping concave line.

Figure 5:
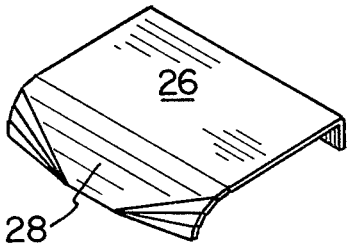
FIG. 5 is a perspective view of a variation of the grate design.

Another grate design which has been found to be effective is shown in FIG. 5. In this design the downwardly sloping surface 28 of the standard grate has been modified by curling the forward edges under. Grates of this shape direct the flow of the fuel to the sides of the grate adjacent the side walls 12 of the burner 8, where it can be mixed with air from the passages 39 and burned.

Experiments have also shown that flow of the fuel down the downwardly sloping surfaces of the grates is smoothest when the downwardly sloping surface of the grates 28 makes an angle with the horizontal that measures less than the angle of repose of the particulate fuel being burned.

In the preferred embodiment, the grates are fabricated of thin gauge metal plate or sheet metal. The grates of the preferred embodiment are shown having a flat horizontal portion and a downwardly sloping portion which meet at a bend, a design chosen because the grates gave good results and were easy to fabricate. However, grates having other shapes may be used without impairing the overall efficiency of the burner. For example, grates whose upper surface has a convex shape with slopes downward toward the closed end 22 have yielded good results.

The desired heat output in a given situation may require a larger firebox with a different number of grates utilizing the same principles as illustrated here for 4 grates.

A grate array in a combustion chamber 10 wider than illustrated would require a replication of the supports 38 extending beyond the fuel line to provide additional continuous air spaces and flame at intervals along the width. The associated bevels 41 of baffle plate 33 will also be repeated.

Although discussion of the application of this burner has been directed toward its use as an incinerator, the system of grates, supports and pipes described above also could be used to heat boiler tubes or a heat exchanger which could be located in the combustion chamber 10. If properly vented, the burner described above also could be used as a space heater.

A burner employing the teachings of this invention will burn safely, efficiently, and smoke and pollution free. The ash generated will be limited to the noncombustible residue carried in with the fuel.

I claim:

1. In a burner for combusting particulate fuels comprising a combustion chamber having a plurality of grates positioned therein in stairstep fashion over which the fuel flows, the improvement comprising said grates having supports which extend beyond the fuel bed and define air passages such that combustion air can bypass the fuel on the grates by flowing through said passages.

2. The burner of claim 1 further comprising a baffle plate positioned above the grates in the path of the fuel and shaped so that the fuel is directed more to the portion of the grate above the air passage.

3. A burner for combusting particulate fuel comprising:

A. a combustion chamber having a top, a bottom, a pair of opposing walls, a closed end and an open end, all having inner and outer surfaces, and a chimney positioned adjacent the closed end of the combustion chamber and communicating with the interior thereof;

B. a plurality of supports within the combustion chamber, each support attached to an inner surface of a wall and projecting inwardly therefrom;

C. a plurality of grates, each having a downwardly sloping surface facing said closed end of the combustion chamber and movably positioned upon a pair of supports so that portions of said supports extend beyond the fuel bed between the grate and the closed end, said grates positioned within the combustion chamber in stairstep fashion;

D. a hopper to receive and contain fuel attached to the outer surface of the top of the combustion chamber and having a base defining an opening above the uppermost grate;

E. a baffle plate extending downward from the hopper base toward the uppermost grate and shaped so that the fuel contained in the hopper is directed to the downwardly sloping surface of the uppermost grate and is distributed more to the portion of the grate adjacent the walls than the portion of the grate located midway between the walls;

F. the top of the combustion chamber being provided with a slot located adjacent the hopper and between the hopper and the closed end; and G. a means for varying the size of the slot.

4. The burner of claim 3 wherein the downwardly sloping surfaces of the grates are shaped so that their forward corners are curled downward and inward.

5. A burner for combusting particulate fuels comprising:

A. a combustion chamber

B. a plurality of grates positioned within the combustion chamber in stairstep fashion, each having a downwardly sloping surface, C. a plurality of bypass channels within the combustion chamber which support the grates and extend beyond the fuel bed, D. a baffle plate for directing the deposition of a fuel bed across the downwardly sloping portion of the grates, which baffle plate is positioned above the uppermost grate and is shaped so that the fuel is distributed more in line with the bypass channels than between them, and E. an exhaust means communicating with the interior of the combustion chamber.

6. A burner for combusting particulate fuels comprising:

A. a combustion chamber

B. a plurality of grates positioned within the combustion chamber in stairstep fashion, each having a downwardly sloping surface, C. a plurality of bypass channels within the combustion chamber which support the grates and extend beyond the fuel bed, D. a means for directing the deposition of a fuel bed across the downwardly sloping portion of the grates, and E. an exhaust means communicating with the interior of the combustion chamber.

7. The burner of claim 6 wherein a top of the combustion chamber includes at least one slot located above the plurality of grates.

8. The burner of claim 7 further comprising a means for varying the size of the slot.

9. The burner of claim 6 further comprising a means for supplying air to the interior of the combustion chamber below and forward of the lowermost grate.

10. The burner of claim 9 wherein the means for supplying air comprises at least one channel located below the lowermost grate.

11. The burner of claim 6 wherein the grates comprise a substantially flat horizontal portion and the downwardly sloping surface is substantially flat.

12. The burner of claim 11 wherein the grates are positioned on the supports such that the front of the grates are in a downwardly sloping concave line.

13. The burner of claim 11 wherein the downwardly sloping surfaces of the grates lie in a common plane.

14. The burner of claim 13 wherein the angle said plane makes with the horizontal is less than the angle of repose of the fuel being burned.

15. The burner of claim 6 wherein the grates are movable along the means for supporting the grates.

16. The burner of claim 6 wherein the bypass channels are sections of angle iron attached to opposing walls of the combustion chamber.

17. The burner of claim 5 wherein the baffle plate comprises a flat plate having a generally rectangular shape in which the corners of the plate adjacent the uppermost grate are beveled.

18. The burner of claim 17 further comprising a hopper in registry with the combustion chamber, said hopper having a base defining a forward portion and an opening above the uppermost grate.

19. The burner of claim 18 wherein the baffle plate extends from the forward portion of the hopper base toward the downwardly sloping surface of the uppermost grate.

20. The burner of claim 5 wherein a top of the combustion chamber includes at least one slot located above the plurality of grates.

21. The burner of claim 20 further comprising a means for varying the size of the slot.

22. The burner of claim 5 further comprising a means for supplying air to the interior of the combustion chamber below and forward of the lowermost grate.

23. The burner of claim 22 wherein the means for supplying air comprises at least one channel located below the lowermost grate.

24. The burner of claim 5 wherein the grates comprise a substantially flat horizontal portion and the downwardly sloping surface is substantially flat.

25. The burner of claim 24 wherein the grates are positioned on the supports such that the front of the grates are in a downwardly sloping concave line.

26. The burner of claim 24 wherein the downwardly sloping surfaces of the grates lie in a common plane.

27. The burner of claim 26 wherein the angle said plane makes with the horizontal is less than the angle of repose of the fuel being burned.

28. The burner of claim 5 wherein the grates are movable along the means for supporting the grates.

* * * * *